United States Patent [19]

Schacht

[11] 3,973,356

[45] Aug. 10, 1976

[54] FLOWER CADDY

[76] Inventor: Louis L. Schacht, 278-3B Crosse Drive, Cranbury, N.J. 08512

[22] Filed: Oct. 16, 1975

[21] Appl. No.: 622,884

[52] U.S. Cl. ..... 47/41 R; 47/34.11; 206/423; 220/8; 229/23 BT; 229/46; 229/52 AC

[51] Int. Cl.[2] ..... B65D 85/50

[58] Field of Search ..... 47/17, 19, 34, 34.11, 47/41, 41.11; 206/423; 229/9, 19, 23 BT, 46, 52 AC; 220/8

[56] References Cited

UNITED STATES PATENTS

| | | | |
|---|---|---|---|
| 311,871 | 2/1885 | Clark | 220/8 |
| 632,612 | 9/1899 | Warfel | 220/8 |
| 760,886 | 5/1904 | Lord | 229/46 |
| 1,504,530 | 8/1924 | Thomas | 220/8 X |
| 1,847,110 | 3/1932 | Holub | 229/46 X |
| 2,771,237 | 11/1956 | Philipson | 229/46 |
| 2,814,910 | 12/1957 | Reparon | 47/34.11 |
| 2,830,406 | 4/1958 | McMurry | 47/41.11 |
| 3,087,666 | 4/1963 | Kitchell | 206/423 X |
| 3,338,388 | 8/1967 | Igoe et al. | 220/8 X |

FOREIGN PATENTS OR APPLICATIONS

| | | | |
|---|---|---|---|
| 292,705 | 6/1967 | Australia | 229/52 AC |
| 432,899 | 8/1935 | United Kingdom | 206/423 |

*Primary Examiner*—William Price
*Assistant Examiner*—Stephen Marcus
*Attorney, Agent, or Firm*—Natter & Natter

[57] ABSTRACT

A caddy providing a protective enclosure for the delivery and display of house plants and cut flowers. The caddy includes a receptacle and interfitting cover. The cover is telescopically slidable over the receptacle and the height is adjustable for accommodating a range of flower sizes and stem lengths. The cover is securable at incremental heights by the cooperative action of a harness attached within the receptacle and extendible through selected registration slots in the receptacle for engagement with the cover. The harness further provides a carrying support for the caddy. The receptacle is also functional as a display vase.

10 Claims, 4 Drawing Figures

FIG. 1
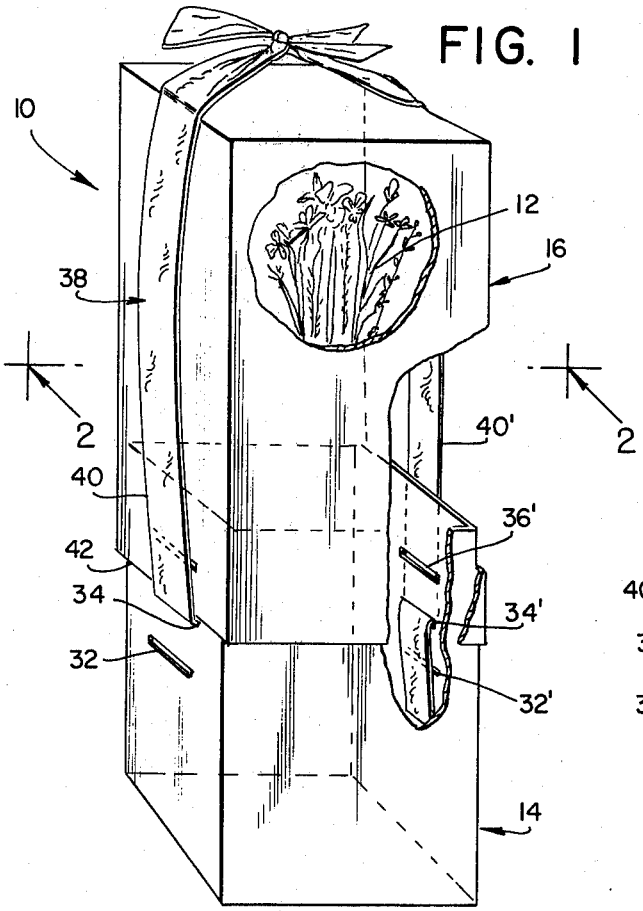
FIG. 2
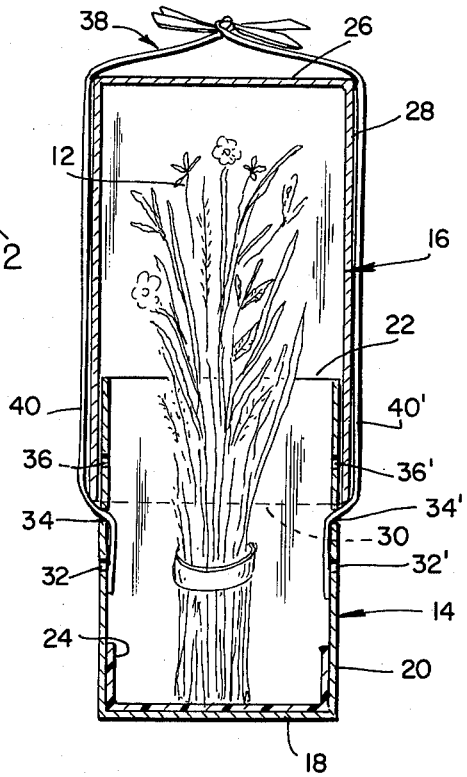
FIG. 3
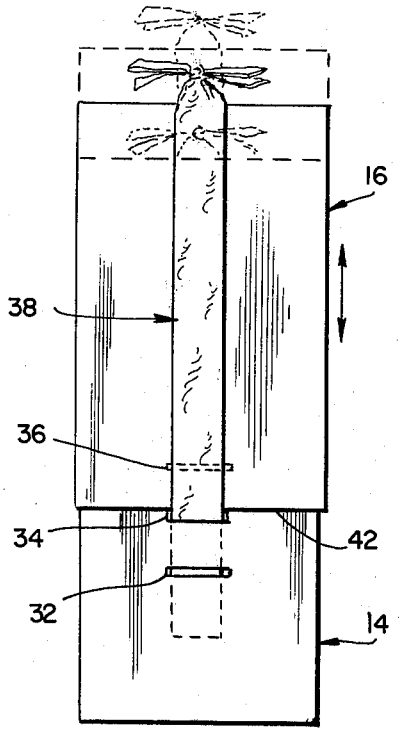
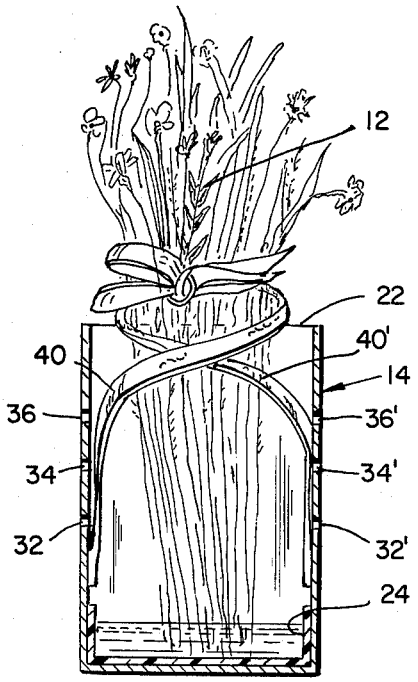
FIG. 4

FLOWER CADDY

BACKGROUND OF THE INVENTION

1. Field of the Invention

The invention relates to special receptacles and packages and in particular to a packaging device for the shipment, storage and display of plants, cut flowers and the like.

The device of this invention is especially concerned with a caddy suitable for delivering ornamental plants and flowers and incorporating a carrying handle. The flower caddy is also convertible into a display vase for holding a flower arrangement.

2. Description of the Prior Art

Florists have traditionally relied upon rather nominal measures for providing a protective enclosure during delivery of flower arrangements. The flower wrapping or covering of the prior art include generally various types of sheet material conventionally placed around the stem portion of a bouquet; open flower baskets are also employed. Frequently the flower blossoms as so transported are left exposed to the elements during delivery and the flower petals become bruised, fall off or are otherwise damaged. Additionally, the floral displays when so transported are more readily subject to disarray. Furthermore, after delivery the recipient must locate a suitable vase or other flower holder. This may present difficulties when, for instance, the flowers are sent to hospital patients.

Another form of flower enclosure of the prior art includes containers or boxes such as noted in U.S. Pat. Nos. 1,270,554 and 3,127,011, wherein the flowers are placed in a selected box of appropriate length for accommodating the particular flowers. The disadvantage of this packaging arrangement is that a sufficient inventory of different length boxes must always be kept on hand. Another reason many of these shipping cartons have not received widespread acceptance is because of the additional expense involved in maintaining the inventory.

In contrast, the caddy of this invention provides a substantially rigid, protective canister in the form of an attractive package which is universally adaptable for containing a wide range of flower sizes and shapes. The outer surface of the package is suitable for bearing advertising copy or designs. A feature of this caddy is that it can completely envelop a bouquet of cut flowers including the stem portion and the blossoms. The caddy can also be used for packaging ornamental house plants including a flower pot.

Another improvement of this caddy device relates to the construction which encompasses slidably adjustable component parts providing greater latitude as to the stem lengths which can be accommodated without crushing or damaging the flowers. A further advantage of the instant caddy is that it has an integral carrying handle and a receptacle component which is also functional for the display of flowers and for providing a water reservoir.

SUMMARY OF THE INVENTION

Briefly, the invention is directed to a combination florist's caddy suitable for the transportation, storage and display of cut flowers as well as ornamental house plants and related articles.

The caddy is constructed of a receptacle component and a cover component for providing a protective enclosure or chamber. The components are movably positionable relative to each other to provide dimensional flexibility for the enclosed space or compartment. The cover component fits slidably over the receptacle. A fastening arrangement including a harness which secures the cover at selected incremental heights corresponding to the height of the flower bouquet or other article contained therein. The securement is effected by the cooperative action of the harness which is inserted through selected registration slots in the receptacle wall and engages the peripheral edge of the cover as it is drawn upwardly and over the top of the cover. Preferably the two free ends of the harness are tied together above the cover and thus provide a convenient carrying handle.

It should be mentioned that the upper limit of the elevated cover positions will be determined by the coincidence of the peripheral edge of the cover with the particular slotted opening through which the harness is inserted. A plurality of spaced registered slots are provided in opposite sides of the receptacle for the opposite free ends of the harness. After delivery of the flowers, the cover can be removed and the receptacle can serve as a vase for the display of the flowers. For this purpose the receptacle is provided with a water impervious lining. When used for delivering potted house plants the receptacle can be used as a decorative covering for the flower pot.

Having thus summarized the invention it will be seen that an object thereof is to provide a caddy for transportation, storage and display of cut flowers, ornamental house plants and like articles of the general character described herein.

Specifically, it is an object of this invention to provide a caddy having a slidable component selectively securable to provide a container having dimensional flexibility for accommodation of a range of different length flowers or other articles.

Another object of this invention is to provide a caddy for the delivery of cut flowers or house plants having an integral carrying handle.

It is a further object of this invention to provide a caddy for the delivery of cut flowers or house plants which is convertible into a display vase.

These and other objects, features and advantages of this invention will be apparent from the following description of the preferred embodiment when considered in connection with the accompanying drawings.

BRIEF DESCRIPTION OF THE DRAWINGS

In the accompanying drawings in which is shown the preferred embodiment of the invention:

FIG. 1 is a perspective view of a caddy of this invention and shows the device in an extended position including a bouquet of flowers packaged therein for delivery;

FIG. 2 is a longitudinal sectional view taken substantially along line 2—2 of FIG. 1 and shows the interrelationship between a slidable cover and a receptacle component of the caddy and includes a harness interlocking the two components and providing a carrying handle;

FIG. 3 is a longitudinal elevation or side view of the caddy of FIG. 1 and diagramatically illustrates the slidable movement (as denoted by the arrows) for positioning the cover component at selected heights (indicated by the dash lines) as determined by the cooperative action of the harness and the locations of the registration slots in the receptacle wall; and FIG. 4 is a sectional view similar to that shown in FIG. 2 with the cover component removed; the receptacle component serves as a water reservoir and vase for display of flowers.

DESCRIPTION OF THE PREFERRED EMBODIMENT

Referring now in detail to the invention, the reference numeral 10 denotes generally a flower caddy of this invention. The caddy 10 is designed for the shipment, storage and display of flowers, ornamental house plants and other such articles. As noted, the caddy 10 is particularly adaptable for providing a protective enclosure during delivery of a bouquet of flowers 12 from a florist shop to a customer and without causing injury to the flower petals or the blossoms. The caddy 10 of this invention is also provided with the improved integral carrying facility and further permits the caddy to be converted into a display vase.

The caddy 10 is constructed from a substantially semi-rigid material shown as rectangular in shape and includes two interfitting components—a base section or receptacle 14 and a cap section or cover 16. The receptacle 14 is closed at a lower margin 18 and includes an upright planar wall portion 20 defining an access opening 22 and is thus capable of supporting cut flowers 12 therein. A water impervious lining 24 is provided contiguous to the lower margin 18 and along a section of the wall portion 20. The cover 16 is closed at an upper margin 26 and includes a downwardly extending planar wall portion 28 terminating at an open end 30. The cover 16 is dimensioned for slidable interfit over the receptacle 14 to provide telescopic movement with respect thereto so that the height of the caddy 10 can be varied in accordance with the dimensional requirements of the article to be contained therein. (See FIG. 3.)

For accomplishing selective height adjustment a plurality of pairs of registration slots, 32, 32′, 34, 34′, 36, 36′ lying respectively in horizontal planes are provided at selected elevations in opposed side walls of the receptacle 14. A harness 38 in the form of a strip of material, leather band or length of ribbon is anchored within the receptacle 14 such that two free ends 40, 40′ are available and are of sufficient length to extend over the cover 16. The ends 40, 40′ are inserted through a selected pair of complementary height slots 34, 34′ as shown in FIGS. 1 and 2 and will thus engage a peripheral edge 42 of the cover 16. The two ends 40, 40′ of of the harness 38 are then drawn up over the cover 16 and tied, buckled or otherwise fastened. It should be apparent that the harness 38 can thus be used as a carrying handle. Furthermore, some slack can be provided when securing the two ends 40, 40′ so that a hand grip can be attached to the harness 38. It should be further noted that although three such pairs of registration slots are shown, the number, spacing and arrangement of these slots can be varied in accordance with particular applications for use of the caddy 10.

In practice, the stem portions of the flowers 12 are first placed in the receptacle 14 and the cover 16 is gently placed over the blossom portions of the flowers 12 and lowered until the peripheral edge 42 is in alignment with a noted registration slot (see FIG. 3) which allows sufficient space underneath the cover 16 for accommodation of the blossom portions of the flowers 12. The cover 16 is then removed and the harness ends 40, 40′ are respectively drawn through the noted registration slots. The cover 16 is replaced and the harness 38 is pulled up over the cover 16 and the two free ends 40, 40′ are secured. It should be noted that the receptacle 14 and the cover 16 will thus be interlocked and that the flowers 12 are enclosed within a protective package.

In addition, after delivery of the caddy 10, the cover 16 can be discarded and the receptacle 14 can be used as a vase as shown in FIG. 4. Further, the water impervious coating or lining 24 placed around the interior surface permits the receptacle to retain a quantity of water, if needed, for the flowers 12.

Additionally, the two ends 40, 40′ of the harness 38 provide a convenient method for securing the flower stems to effect a particular floral arrangement. The ends 40, 40′ can be wrapped around the flowers as illustrated and tied in an ornamental bow. This will provide an added decorative feature especially if the harness 38 is formed of lengths of colorful ribbon.

It should thus be apparent that the florist's caddy as hereinbefore described functions as a multipurpose article. The above embodiment is intended as exemplary, and while it has described the invention with specific implementation thereof, other modifications and changes may be apparent to those skilled in the art. Therefore it should be understood that all material shown and described in the accompanying drawings is to be interpreted as illustrative and not in a limiting sense.

Having thus described the invention, there is claimed as new and desired to be secured by Letters Patent:

1. A caddy adapted for the packaging, transporting and displaying of flowers comprising receptacle means for containing the stem portions of the flowers, cover means for surrounding the blossom portions of the flowers, said cover means being adapted for slidable interfit over the receptacle means and for selective positioning with respect to the receptacle means, fastening means for securing the cover means to the receptacle means at selected heights, the caddy being adjustable in accordance with the dimensional features of the article to be packaged, said fastening means further providing integral handle means for carrying the caddy whereby the caddy provides an enclosed protective package suitable for the delivery of flowers.

2. A caddy as claimed in claim 1 wherein the receptacle means comprises a container being closed at its lower margin and includes an upright wall portion defining an access opening wherein cut flowers can be supported within the receptacle, and the caddy can be utilized without the cover means for displaying cut flowers.

3. A caddy as claimed in claim 2 further including a water impervious lining material within the receptacle means contiguous with the lower margin and section of the wall portion whereby a water reservoir can be maintained within the receptacle for the cut flowers.

4. A caddy as claimed in claim 2 wherein the cover means is closed at its upper margin and includes a downwardly extending wall portion defining an open end, said open end conforming in shape to the receptacle access opening and being dimensioned for slidable interfitting over the receptacle to provide telescopic movement with respect thereto whereby the height of the caddy can be varied in accordance with the lengths of the cut flowers to be placed therein.

5. A caddy as claimed in claim 4 wherein the receptacle means is provided with a plurality of height registration slots, said fastening means including a harness affixed to the receptacle means and having an end insertable through selected registration slots for engaging the cover means.

6. A caddy as claimed in claim 5 wherein the harness includes a ribbon attached to the interior wall of the receptacle and being of compatible width for passage through a registration slot.

7. A caddy as claimed in claim 5 wherein the height registration slots are aligned in respective pairs at different elevations along opposite wall portions of the receptacle means.

8. A caddy as claimed in claim 7 wherein the ends of the harness are each extendible through respective pairs of registration slots for engagement with a peripheral edge of the cover means.

9. A caddy as claimed in claim 8 wherein the harness is extendible over the cover means for interlockingly securing the receptacle means and the cover means at selected heights and for providing a carrying handle for the caddy.

10. A caddy as claimed in claim 8 wherein the peripheral edge of the cover means is aligned coincidentally with a pair of selected registration slots when interlockingly secured to the receptacle by the harness.

* * * * *